US005447132A

United States Patent [19]

Shoda et al.

[11] Patent Number: 5,447,132

[45] Date of Patent: Sep. 5, 1995

[54] CONTROL SYSTEM FOR MULTIPLE ENGINES

[75] Inventors: Minpei Shoda; Kunihiko Imanishi, both of Hirakata, Japan

[73] Assignee: Kabushiki Kaisha Komatsu Seisakusho, Tokyo, Japan

[21] Appl. No.: 248,871

[22] Filed: May 24, 1994

[30] Foreign Application Priority Data

May 24, 1993 [JP] Japan ..... 5-031838 U

[51] Int. Cl.[6] ..... F02D 1/00

[52] U.S. Cl. ..... 123/357; 123/DIG. 8

[58] Field of Search ..... 123/352, 357, 361, 399, 123/DIG. 8

[56] References Cited

U.S. PATENT DOCUMENTS

| | | | |
|---|---|---|---|
| 2,545,458 | 3/1951 | Ginn | 123/DIG. 8 |
| 3,743,064 | 7/1973 | Luft | 123/DIG. 8 |
| 4,442,805 | 4/1984 | Yamakawa | 123/DIG. 8 |
| 4,480,612 | 11/1984 | Yamakawa | 123/DIG. 8 |
| 4,576,137 | 3/1986 | Tanaka | 123/575 |
| 4,773,372 | 9/1988 | Stumm et al. | 123/DIG. 8 |
| 4,811,255 | 3/1989 | Kelly, III | 123/351 |

*Primary Examiner*—Thomas N. Moulis

*Attorney, Agent, or Firm*—Richards, Medlock & Andrews

[57] ABSTRACT

A control system for operating two engines (3, 4) is installed on a construction machine, such as a hydraulic shovel, to provide for the operation of either engine or both of the engines, to improve operability and to reduce the stress on the operator. The control system has a governor controller (5, 6) for each engine, a dial potentiometer (1) for providing a throttle signal representing the desired revolution rates of the engines from a low speed to a high speed, and a selector switch (2) having a plurality of control positions (F, N and R) for selecting an individual engine or a combination of the engines. In a first control position (F), the selector switch (2) connects the dial potentiometer (1) to only the governor controller (5) of the first engine (3); in the second control position (N), the selector switch (2) connects the dial potentiometer (1) to the governor controllers (5 and 6) of both engines (3 and 4); and in the third control position (R), the selector switch (2) connects the dial potentiometer (1) to only the governor controller (6) of the second engine (3). The selector switch circuit can employ a relay (Re) to actuate relay switches ($Re_1$, $Re_2$) to provide the desired switching.

8 Claims, 4 Drawing Sheets

CONTROL SYSTEM FOR MULTIPLE ENGINES

FIELD OF THE INVENTION

The present invention relates to the control of multiple engines on a machine which employs a plurality of engines as motive sources. In a specific aspect, the invention relates to an improvement in a control system for controlling two drive engines on a construction machine.

RELATED BACKGROUND ART

The control of engine revolution rate in most recent construction machines, such as hydraulic shovels, is carried out by using a motor to drive a governor lever of an engine in response to an input signal which is obtained as a variation of the electric resistance of a potentiometer. In an operation method for this potentiometer, as illustrated in FIG. 3, a dial potentiometer 11 is rotated to the desired position to send a throttle signal to the governor controller 17 of the engine 16. The governor controller 17 transmits a drive signal to a governor motor 18 to drive a governor lever of the engine 16, and a feedback signal is transmitted from a sensor 21 associated with the governor motor 18 to the governor controller 17 so that the revolution rate of engine 16 is regulated in response to the received drive signal. Reference number 19*a* denotes a starter switch, while reference number 19*b* denotes a starter for the engine 16.

Lever potentiometers have been employed, as shown in FIG. 4, but a dial potentiometer is advantageous in that, as it does not require as much space on a control panel, the control panel can have a compact arrangement. However, the dial potentiometer has been employed primarily for single engine construction machines.

Most large-sized construction machines employ at least two drive engines because a single drive engine cannot provide sufficient power for all operations. While, in the case of the lever potentiometer, two levers 12 and 13 can be positioned, as shown in FIG. 4, for simultaneous operation, a large force is required for such simultaneous operation of both levers. Moreover, a large lever stroke requires a large space in the control panel, and the construction of the control panel is complex.

On the other hand, the dial potentiometer does not require a large force, it can be mounted in a compact space, and the construction of the control panel is simple. However, for a two-engine construction machine employing dial type potentiometers 14, 15, there is a problem in that both engines cannot be adjusted simultaneously unless both dials 14 and 15 are rotated simultaneously, thus requiring both hands of the operator, as shown in FIG. 5. Thus, the operability is unsatisfactory.

SUMMARY OF THE INVENTION

An object of the present invention, made to solve a problem as described above, is to provide an engine control system which can be employed in construction machines having multiple drive engines, such as a two-engine hydraulic shovel, wherein the control of the engine revolution rate of both engines can be simultaneously effected by a single hand.

In accordance with the present invention, a system for controlling multiple engines of a construction machine which employs a plurality of engines as motive sources, comprises a governor controller for each engine, a single dial potentiometer for controlling engine revolution rate from a low speed to a high speed, and a selector switch having a plurality of control positions for selecting an individual engine or a combination of engines. In a first control position, the selector switch connects the dial potentiometer to only the governor controller of a first engine; in a second control position, the selector switch connects the dial potentiometer to the governor controllers of a combination of engines; and in a third control position, the selector switch connects the dial potentiometer to only the governor controller of the second engine. The selector switch circuit can employ a relay to actuate relay switches to provide the desired switching. The dial potentiometer and the selector switch can be positioned adjacent to each other on a control panel.

In an arrangement as described above, the selector switch can be connected to a desired governor controller or to a combination of governor controllers by merely moving the selector switch to the desired control position. Thus, either engine can be operated individually or both of the engines can be operated with simultaneous adjustment of both engines being accomplished by a single dial potentiometer, requiring only one hand of the operator. Thus two engines can be operated as a single engine to improve the operability.

BEST MODE FOR CARRYING OUT THE INVENTION

Figure 1:
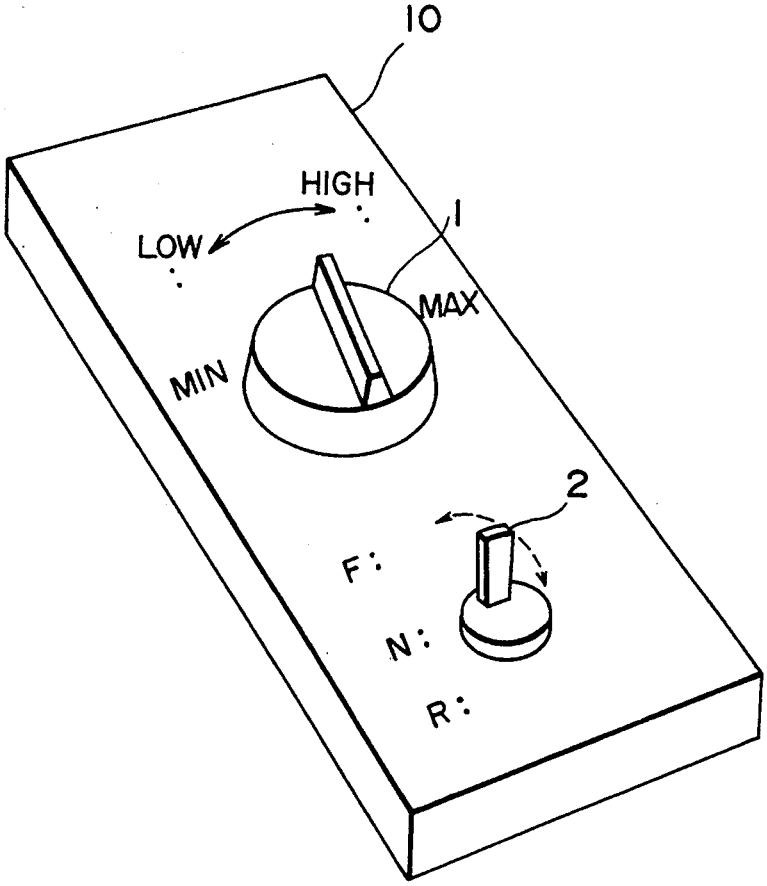
FIG. 1 is a perspective view of a control panel for two-engine control according to an embodiment of the present invention.
Figure 2:
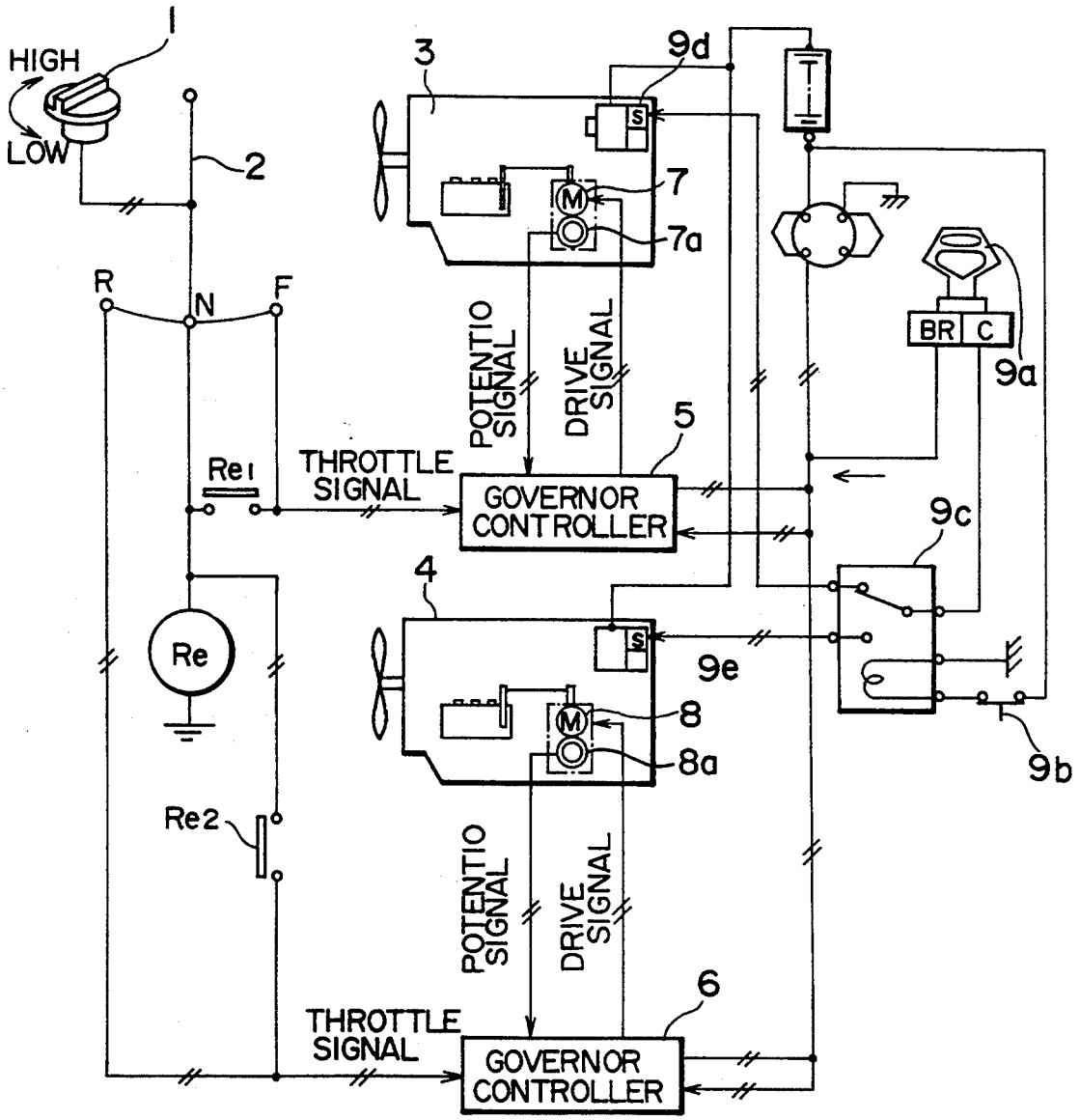
FIG. 2 is an electric circuit diagram which utilizes a single dial potentiometer to control two engines in accordance with the present invention.
Figure 3:
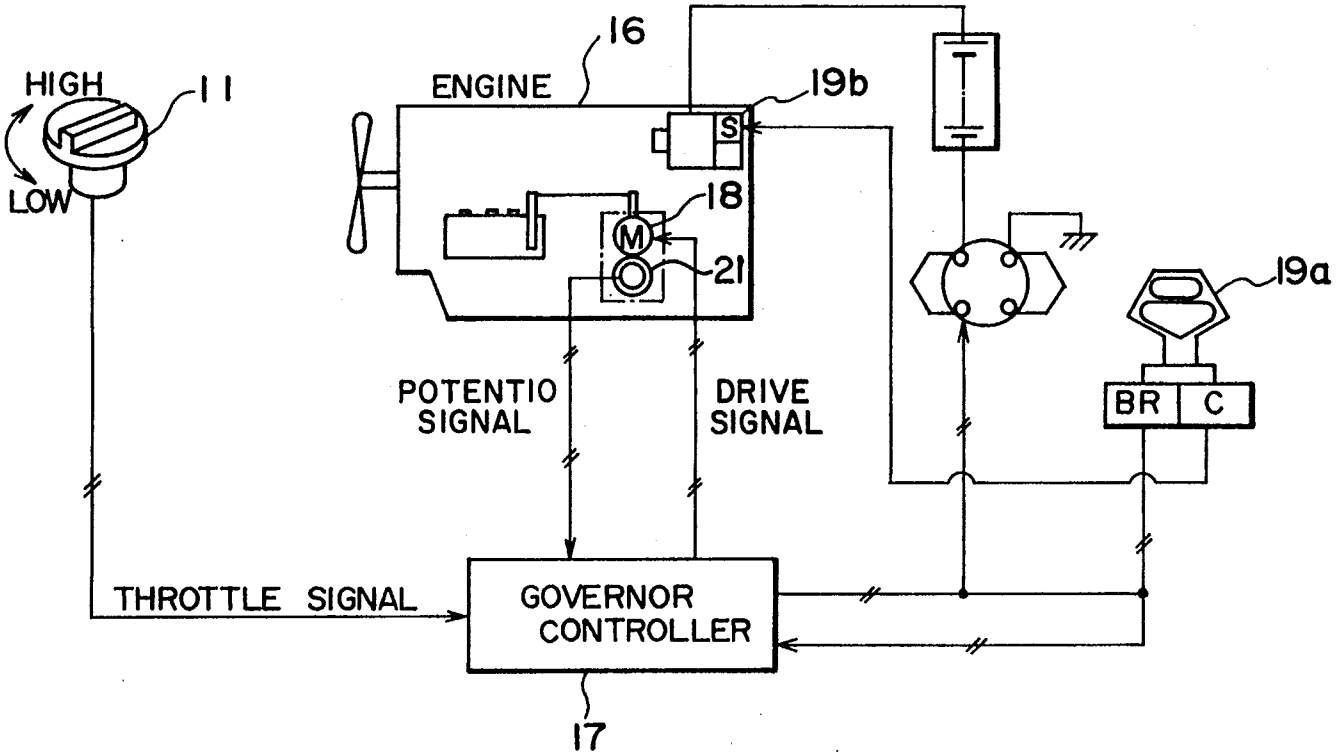
FIG. 3 PRIOR ART
FIG. 3 is an illustration of a control system according to the related art.
Figure 4:
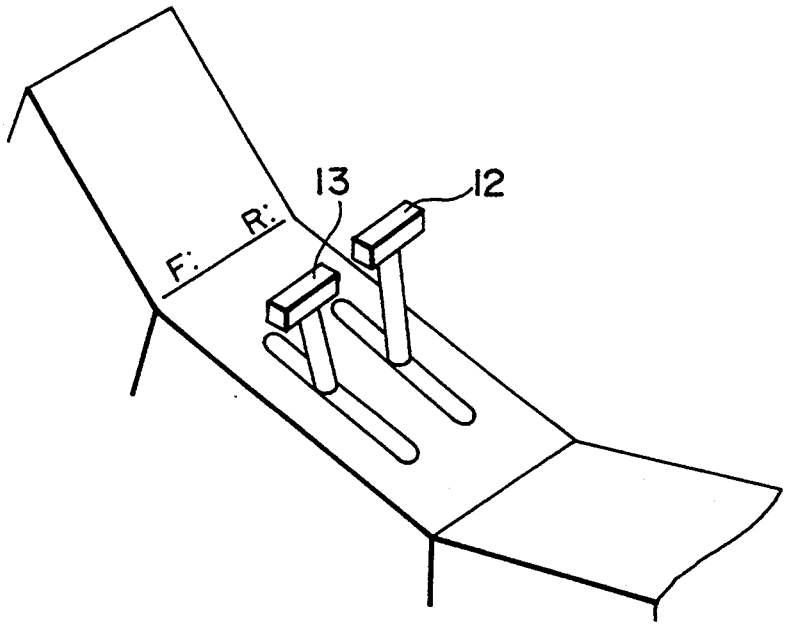
FIG. 4 PRIOR ART
FIG. 4 is a perspective view of a lever throttle according to the related art.
Figure 5:
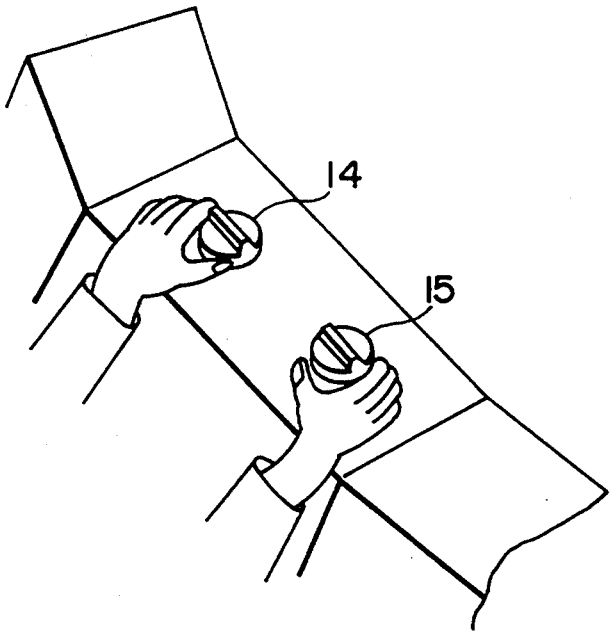
FIG. 5 PRIOR ART
FIG. 5 is a perspective view of a two-engine control employing two dial potentiometers according to the related art.

A two-engine control system according to an embodiment of the present invention is described below, with reference to FIGS. 1 and 2.

A control panel 10 is provided with a dial potentiometer 1 and a selector switch 2. The single dial potentiometer 1 controls the engine revolution rate of each of engines 3 and 4 from a low speed to a high speed. The selector switch 2 is positioned on the control panel 10 closely adjacent to the dial potentiometer 1, and has three control positions F, N and R, as shown in FIG. 1.

At the F position of selector switch 2, the dial potentiometer 1 is connected only to a governor controller 5 of a first engine 3. At the N position of selector switch 2, the dial potentiometer 1 is connected to both the governor controller 5 of the first engine 3 and the governor controller 6 of the second engine 4. At the R position of the selector switch 2, the dial potentiometer 1 is connected only to the governor controller 6 of the second engine 4. The governor controller 5 is connected to the governor motor 7 of the first engine 3, while the governor controller 6 is connected to the governor motor 8 of the second engine 4. A sensor 7*a* associated with the governor motor 7 provides a feedback signal to the governor controller 5, while a sensor 8*a* associated with the governor motor 8 provides a feedback signal to the governor controller 6.

The panel 10 is provided in the operator cabin of a construction machine vehicle. The engine revolution rate is gradually increased when an operator turns the dial potentiometer 1 clockwise, and is gradually decreased when the operator turns the dial potentiometer 1 counterclockwise. The selector switch 2 on the panel 10 is manually changed over by the operator so that the F position is selected when the selector switch 2 is shifted fully to the front, the N position is selected when the selector switch 2 is shifted to the intermediate position, and the R position is selected when the selector switch 2 is shifted fully to the rear.

When the selector switch 2 is in the F position, the dial potentiometer 1 is connected to an input of governor controller 5 so as to input a throttle signal to the governor controller 5 for controlling the revolution rate of engine 3. When the selector switch 2 is in the R position, the dial potentiometer 1 is connected to an input of governor controller 6 so as to input a throttle signal to the governor controller 6 for controlling the revolution rate of engine 4. When the selector switch 2 is in the N position, a relay Re is excited so as to cause relay switches $Re_1$ and $Re_2$ to be moved to the closed position, thereby connecting the dial potentiometer 1 to both the governor controller 5 for controlling the revolution rate of engine 3 and to the governor controller 6 for controlling the revolution rate of engine 4. Reference character 9*a* designates a start switch, 9*b* designates a start changeover switch, 9*c* designates a start changeover relay, and each of 9*d* and 9*e* designates a starter.

Operation of the present embodiment is described below.

When the selector switch 2 is actuated to the F position, a throttle signal of the dial potentiometer 1 is sent only to the governor controller 5 of the first engine 3. The governor controller 5 transmits a drive signal to the governor motor 7, whereby the governor motor 7 regulates the revolution rate of engine 3 in response to the throttle signal from dial potentiometer 1. When the selector switch 2 is actuated to the R position, the throttle signal of the dial potentiometer 1 is sent only to the governor controller 6 of the second engine 4. The governor controller 6 then sends a drive signal to the governor motor 8, whereby the governor motor 8 regulates the revolution rate of engine 4 in response to the throttle signal from the dial potentiometer 1. When the selector switch 2 is actuated to the N position, the relay Re is excited to close relay switches $Re_1$ and $Re_2$ and simultaneously input the throttle signal of the dial potentiometer 1 to both the governor controller 5 and the governor controller 6. The drive signals of governor controllers 5 and 6 are sent to governor motors 7 and 8, respectively, which are thereby simultaneously regulated. Either or both of engines 3 and 4 can be operated according to an operator's selection of the position of the selector switch 2. The revolution rate of the engine or engines being controlled is adjusted to a desired rate by clockwise or counterclockwise rotation of the single dial potentiometer 1 by the operator.

Thus, the two engines 3 and 4 can be operated as a single engine, thereby improving the operability. The use of a single dial potentiometer permits a compact control panel, enables cost reduction, and reduces stress on the operator.

While the invention has been illustrated as a control system for controlling the revolution rate of two engines, the invention is applicable to the control of three or more engines. With more than two engines, the selection switch 2 can be provided with a control position for each individual engine, if desired, and a control position for each combination of engines which is desired. Thus, on a vehicle having four drive motors, one control position of the selector switch 2 could provide for the operation of only the right front engine, another control position of the selector switch 2 could provide for the operation of only the left front engine, a third control position of the selector switch 2 could provide for the simultaneous operation of only the two front engines, and a fourth control position could provide for the simultaneous operation of all four engines.

What is claimed is:

1. A control system for controlling the revolution rate of a plurality of engines, said system comprising:

a plurality of governor controllers, each of said plurality of governor controllers being associated with a respective one of said plurality of engines;

a single dial potentiometer for providing a throttle signal representing a desired engine revolution rate, from a low speed to a high speed; and a selector switch having a plurality of control positions, whereby in a first control position the selector switch connects the dial potentiometer to only the governor controller of a first one of said plurality of engines, in a second control position the selector switch connects the dial potentiometer to the governor controllers of at least two of said plurality of engines, and in a third control position the selector switch connects the dial potentiometer to only the governor controller of a second one of said plurality of engines.

2. A control system in accordance with claim 1, further comprising a control panel, said dial potentiometer being mounted on said control panel, said selector switch being mounted on said control panel near said dial potentiometer.

3. A control system in accordance with claim 1, wherein said plurality of engines comprises a first engine and a second engine, wherein in said second control position the selector switch connects the dial potentiometer to the governor controller of said first engine and to the governor controller of said second engine so that the control of the engine revolution rate of both engines can be simultaneously effected by a single hand.

4. A control system in accordance with claim 1, further comprising a relay and first and second relay switches, wherein said relay is excited when said selector switch is changed over to the second control position and moves each of said first and second relay switches to a closed position to thereby connect said dial potentiometer to the governor controller of said first engine and to the governor controller of said second engine.

5. A construction machine having a plurality of engines as motive sources, and a control system for controlling the revolution rate of each of said plurality of engines, said system comprising:

a plurality of governor controllers, each of said plurality of governor controllers being associated with a respective one of said plurality of engines;

a single dial potentiometer for providing a throttle signal representing a desired engine revolution rate, from a low speed to a high speed; and a selector switch having a plurality of control positions, said single dial potentiometer being connected to said selector switch and said selector switch being selectively connected to said governor controllers such that in a first control position the selector switch connects the dial potentiometer to only the governor controller of a first one of said plurality of engines, in a second control position the selector switch connects the dial potentiometer to the governor controllers of at least two of said plurality of engines, and in a third control position the selector switch connects the dial potentiometer to only the governor controller of a second one of said plurality of engines.

6. A construction machine in accordance with claim 5, further comprising a control panel, said dial potentiometer being mounted on said control panel, said selector switch being mounted on said control panel near said dial potentiometer.

7. A construction machine in accordance with claim 5, wherein said plurality of engines comprises a first engine and a second engine, wherein in said second control position the selector switch connects the dial potentiometer to the governor controller of said first engine and to the governor controller of said second engine so that the control of the engine revolution rate of both engines can be simultaneously effected by a single hand of an operator.

8. A construction machine in accordance with claim 5, further comprising a relay and first and second relay switches, wherein said relay is excited when said selector switch is changed over to the second control position and moves each of said first and second relay switches to a closed position to thereby connect said dial potentiometer to the governor controller of said first engine and to the governor controller of said second engine.

* * * * *